US005953836A

United States Patent [19]

Watt et al.

[11] Patent Number: 5,953,836

[45] Date of Patent: Sep. 21, 1999

[54] SHOE HAVING A REMOVABLE HEEL

[76] Inventors: William T. Watt; Lisa C. Watt, both of 936 Birch St., Reading, Pa. 19604

[21] Appl. No.: 09/031,473

[22] Filed: Feb. 26, 1998

[51] Int. Cl.[6] ..... A43B 21/36; A43B 3/24

[52] U.S. Cl. ..... 36/42; 36/100

[58] Field of Search ..... 36/100, 101, 42

[56] References Cited

U.S. PATENT DOCUMENTS

| | | | |
|---|---|---|---|
| 980,987 | 1/1911 | Mitlehner | 36/42 |
| 1,743,543 | 1/1930 | Gutierrez | 36/42 |
| 2,707,341 | 5/1955 | Romano | 36/42 X |
| 3,078,599 | 2/1963 | Mileto | 36/42 |
| 3,193,949 | 7/1965 | Cortina | 36/42 |
| 4,416,072 | 11/1983 | Sarkissian | 36/42 X |
| 5,133,138 | 7/1992 | Durcho | 36/36 R |

FOREIGN PATENT DOCUMENTS

| | | | |
|---|---|---|---|
| 2519849 | 7/1983 | France | 36/42 |

*Primary Examiner*—B. Dayoan

[57] ABSTRACT

A new shoe having removable heels for permitting a user to wear a single pair of shoes which can be used in high heel form and in a flat form. The inventive device includes a sole having opposite heel and toe ends. The lower surface of the sole has a hole therein located towards the heel end of the sole. The hole has a perimeter with a number of sides. Each of the sides of the perimeter of the hole has an aperture into the sole. A heel is also provided and has a block outwardly extended from its upper end. The block also has a number of sides with each of the sides of the block associated with a side of the perimeter of the hole. The block is removably inserted into the hole of the lower surface of the sole and each of the sides of the block has a detent which are inserted into the aperture of their associated side of the perimeter of the hole.

10 Claims, 2 Drawing Sheets

SHOE HAVING A REMOVABLE HEEL

BACKGROUND OF THE INVENTION

1. Field of the Invention

The present invention relates to shoes and more particularly pertains to a new shoe having removable heels for permitting a user to wear a single pair of shoes which can be used in high heel form and in a flat form.

2. Description of the Prior Art

The use of shoes is known in the prior art. More specifically, shoes heretofore devised and utilized are known to consist basically of familiar, expected and obvious structural configurations, notwithstanding the myriad of designs encompassed by the crowded prior art which have been developed for the fulfillment of countless objectives and requirements.

Known prior art shoes include U.S. Pat. Nos. 4,219,946; 4,214,384; 4,805,320; 3,946,505; Des. 347,937; and 4,062,132.

While these devices fulfill their respective, particular objectives and requirements, the aforementioned patents do not disclose a new shoe having removable heels. The inventive device includes a sole having opposite heel and toe ends. The lower surface of the sole has a hole therein located towards the heel end of the sole. The hole has a perimeter with a number of sides. Each of the sides of the perimeter of the hole has an aperture into the sole. A heel is also provided and has a block outwardly extended from its upper end. The block also has a number of sides with each of the sides of the block associated with a side of the perimeter of the hole. The block is removably inserted into the hole of the lower surface of the sole and each of the sides of the block has a detent which are inserted into the aperture of their associated side of the perimeter of the hole.

In these respects, the shoe having removable heels according to the present invention substantially departs from the conventional concepts and designs of the prior art, and in so doing provides an apparatus primarily developed for the purpose of permitting a user to wear a single pair of shoes which can be used in high heel form and in a flat form.

SUMMARY OF THE INVENTION

In view of the foregoing disadvantages inherent in the known types of shoes now present in the prior art, the present invention provides a new shoe having removable heels construction wherein the same can be utilized for permitting a user to wear a single pair of shoes which can be used in high heel form and in a flat form.

The general purpose of the present invention, which will be described subsequently in greater detail, is to provide a new shoe having removable heels apparatus and method which has many of the advantages of the shoes mentioned heretofore and many novel features that result in a new shoe having removable heels which is not anticipated, rendered obvious, suggested, or even implied by any of the prior art shoes, either alone or in any combination thereof.

To attain this, the present invention generally comprises a sole having opposite heel and toe ends. The lower surface of the sole has a hole therein located towards the heel end of the sole. The hole has a perimeter with a number of sides. Each of the sides of the perimeter of the hole has an aperture into the sole. A heel is also provided and has a block outwardly extended from its upper end. The block also has a number of sides with each of the sides of the block associated with a side of the perimeter of the hole. The block is removably inserted into the hole of the lower surface of the sole and each of the sides of the block has a detent which are inserted into the aperture of their associated side of the perimeter of the hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoe having removable heels apparatus and method which has many of the advantages of the shoes mentioned heretofore and many novel features that result in a new shoe having removable heels which is not anticipated, rendered obvious, suggested, or even implied by any of the prior art shoes, either alone or in any combination thereof.

It is another object of the present invention to provide a new shoe having removable heels which may be easily and efficiently manufactured and marketed.

It is a further object of the present invention to provide a new shoe having removable heels which is of a durable and reliable construction.

An even further object of the present invention is to provide a new shoe having removable heels which is susceptible of a low cost of manufacture with regard to both materials and labor, and which accordingly is then susceptible of low prices of sale to the consuming public, thereby making such shoe having removable heels economically available to the buying public.

Still yet another object of the present invention is to provide a new shoe having removable heels which provides in the apparatuses and methods of the prior art some of the advantages thereof, while simultaneously overcoming some of the disadvantages normally associated therewith.

Still another object of the present invention is to provide a new shoe having removable heels for permitting a user to wear a single pair of shoes which can be used in high heel form and in a flat form.

Yet another object of the present invention is to provide a new shoe having removable heels which includes a sole having opposite heel and toe ends. The lower surface of the sole has a hole therein located towards the heel end of the sole. The hole has a perimeter with a number of sides. Each of the sides of the perimeter of the hole has an aperture into the sole. A heel is also provided and has a block outwardly extended from its upper end. The block also has a number of sides with each of the sides of the block associated with a side of the perimeter of the hole. The block is removably inserted into the hole of the lower surface of the sole and each of the sides of the block has a detent which are inserted into the aperture of their associated side of the perimeter of the hole.

Still yet another object of the present invention is to provide a new shoe having removable heels that allows a user, especially a woman, to change from a high heeled shoe to a more comfortable flat shoe thereby eliminating the problem women have with wearing uncomfortable high heeled shoes all day.

Even still another object of the present invention is to provide a new shoe having removable heels that allows a user to easily and quickly replace a damaged heel of a shoe.

Even yet still another object of the present invention is to provide a new shoe having removable heels that allow interchangeability between different heels so that different sized (either in height or in width) heels may be used on the same shoe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
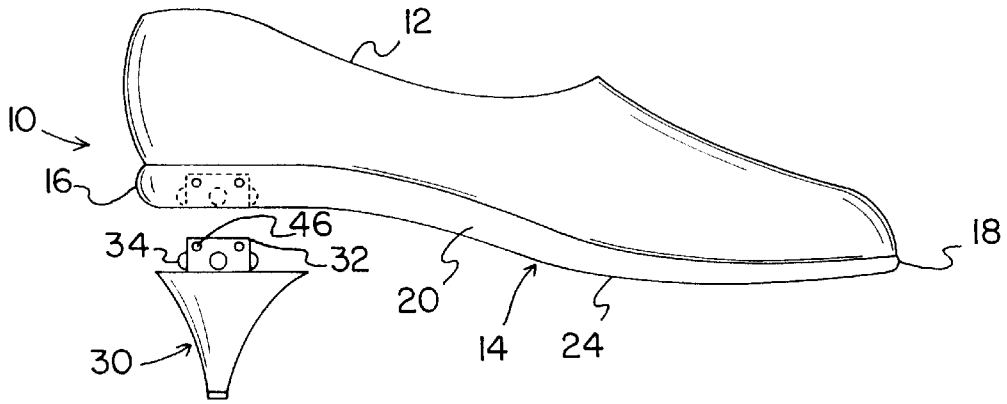
FIG. 1 is a schematic side view of a new shoe having removable heels according to the present invention.
Figure 2:
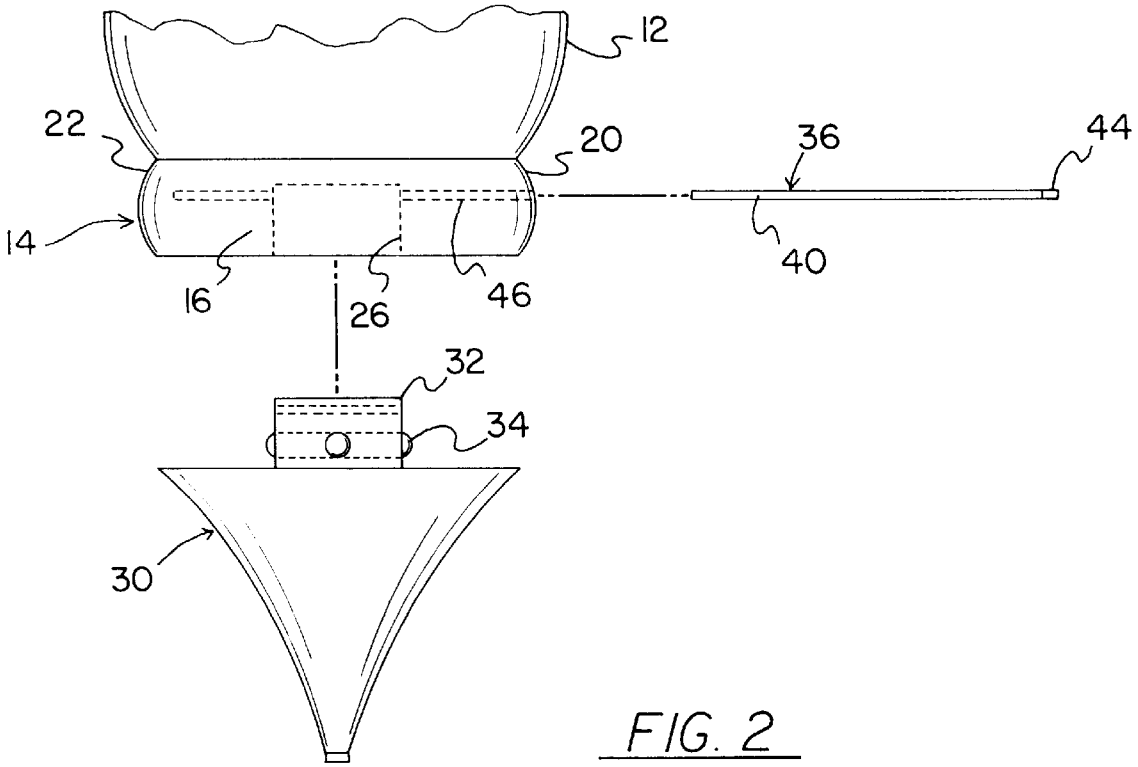
FIG. 2 is a schematic exploded heel end side view of the present invention.
Figure 3:
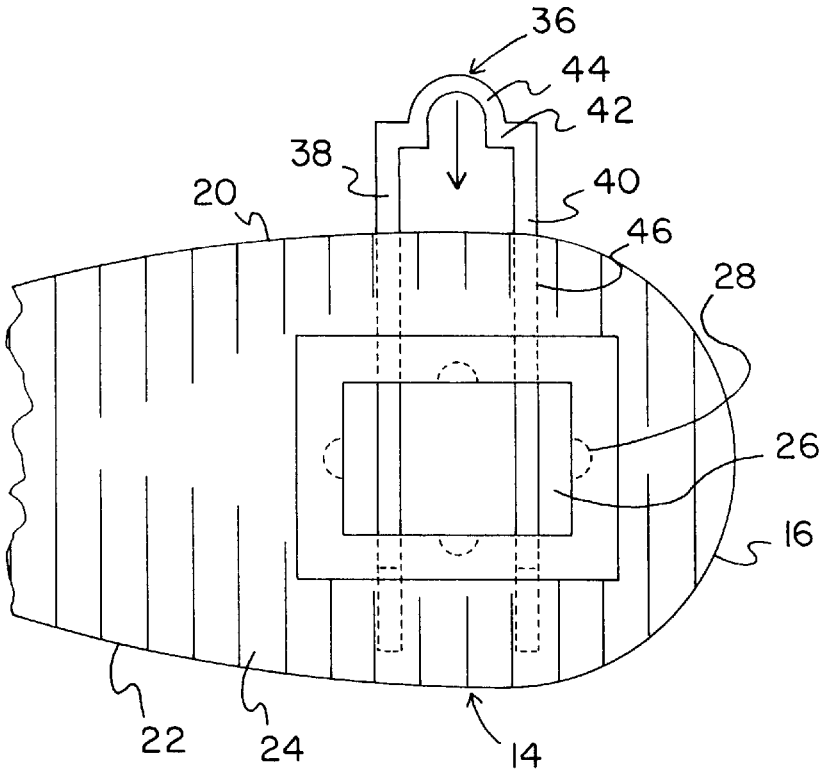
FIG. 3 is a schematic bottom side view of the sole of the present invention.
Figure 4:
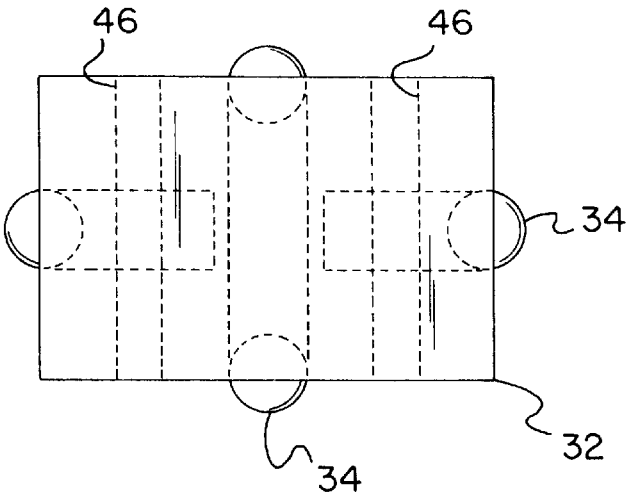
FIG. 4 is a schematic top view of the heel of the present invention.

With reference now to the drawings, and in particular to FIGS. 1 through 4 thereof, a new shoe having removable heels embodying the principles and concepts of the present invention and generally designated by the reference numeral 10 will be described.

As best illustrated in FIGS. 1 through 4, the shoe having removable heels 10 generally comprises a sole 14 having opposite heel and toe ends 16,18. The lower surface 24 of the sole 14 has a hole 26 therein located towards the heel end 16 of the sole 14. The hole 26 has a perimeter with a number of sides. Each of the sides of the perimeter of the hole 26 has an aperture 28 into the sole 14. A heel 30 is also provided and has a block 32 outwardly extended from its upper end. The block 32 also has a number of sides with each of the sides of the block 32 associated with a side of the perimeter of the hole 26. The block 32 is removably inserted into the hole 26 of the lower surface 24 of the sole 14 and each of the sides of the block 32 has a detent which are inserted into the aperture of their associated side of the perimeter of the hole 26.

In closer detail, the shoe 10 has some sort of upper 12 and a sole 14. The sole 14 has a lower surface 24, opposite heel 30 and toe ends 16,18, and a pair of sides extending between the heel 30 and toe ends 16,18 of the sole 14. The lower surface 24 of the sole 14 has a hole 26 in it. The hole 26 has a perimeter, preferably generally rectangular in shape, which has a number of sides. Each of the sides of the perimeter of the hole 26 has an aperture 28 into the sole 14.

As illustrated in the Figures, the upper end of the heel 30 has a block 32 outwardly extending therefrom. The block 32 has a number of sides extending therearound which define the generally rectangular perimeter of the block 32. Each of the sides of the block 32 is associated with a side of the perimeter of the hole 26. The block 32 is removably inserted into the hole 26 of the lower surface 24 of the sole 14, preferably such that the heel 30 abuts the lower surface 24 of the sole 14.

Each of the sides of the block 32 has a detent which are inserted into their respective aperture 28 of their associated sides of the perimeter of the hole 26. The detents 34 are insertable into the apertures 28 for releasably engaging the perimeter of the hole 26 to help hold the block 32 to the sole 14. Preferably, each of the detents 34 comprise a ball and a spring with the spring located in the interior of the block 32 and the ball extending from its respective side of the block 32.

Preferably, the invention includes a generally rectangular U-shaped securing pin 36 having a pair of spaced apart elongate arms 38,40 connected by a cross member 42. The arms 38,40 of the securing pin 36 are removably inserted through a pair of bores 46 extending from one of the sides 20 of the sole 14 and into the hole 26 and the block 32 (preferably through the block 32 and into a distal side of the hole 26). The securing pin 36 is designed for helping securely hold the block 32 in the hole 26 of the sole 14. In the preferred embodiment, the cross member 42 of the securing pin 36 has an arcuate portion 44 extending in a direction opposite the arms 38,40 of the securing pin 36 such that the arcuate portion 44 outwardly extends from the side of the sole 14 when the securing pin 36 is inserted into the side of the sole 14. The arcuate portion 44 helps a user easily remove the securing pin 36 from the side 20 of the sole 14 with one of their fingers.

In an illustrative example for a typically sized women's shoe, the block 32 has a height measured from the heel 30 of less than about ¾ inch, and a length and a width defined between the sides of the block 32 of 1¼ inches and ½ inch, respectively.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shoe, comprising:

a sole having a lower surface, opposite heel and toe ends, and a pair of sides extending between said heel and toe ends of said sole;

said lower surface of said sole having a hole therein, said hole being located towards said heel end of said sole, said hole having a perimeter, said perimeter of said hole having a number of sides;

each of said sides of said perimeter of said hole having an aperture into said sole;

a heel having an upper end;

said upper end of said heel having a block being outwardly extended therefrom, said block having a number of sides, each of said sides of said block being associated with a side of said perimeter of said hole;

said block being removably inserted into said hole of said lower surface of said sole;

each of said sides of said block having a detent, each of said detents being inserted into the aperture of its associated side of said perimeter of said hole; and a secure pin being removably inserted through one of said sides of said sole and into said hole and said block.

2. The shoe of claim 1, wherein said perimeter of said hole is generally rectangular perimeter, and wherein said sides of said block define a generally rectangular block perimeter.

3. The shoe of claim 1, wherein each of said detents comprises a ball and a spring, said spring being located in the interior of said block, said ball being extended from its respective side of said block.

4. The shoe of claim 1, wherein said securing pin is generally U-shaped and has a pair of spaced apart elongate arms being connected by a cross member, said arms of said securing pin being removably inserted through said one of said sides of said sole and into said hole and said block.

5. The shoe of claim 4, wherein said cross member of said securing pin has an arcuate portion being extended in a direction opposite said arms of said securing pin.

6. A shoe, comprising:

a sole having a lower surface, opposite heel and toe ends, and a pair of sides extending between said heel and toe ends of said sole;

said lower surface of said sole having a hole therein, said hole being located towards said heel end of said sole, said hole having a perimeter, wherein said perimeter of said hole is generally rectangular perimeter, said perimeter of said hole having a number of sides;

each of said sides of said perimeter of said hole having an aperture into said sole;

a heel having an upper end;

said upper end of said heel having a block being outwardly extended therefrom, said block having a number of sides, each of said sides of said block being associated with a side of said perimeter of said hole;

said block being removably inserted into said hole of said lower surface of said sole;

each of said sides of said block having a detent, each of said detents being inserted into the aperture of its associated side of said perimeter of said hole, said detents releasably engaging said perimeter of said hole to help hold said block to said sole, wherein each of said detents comprise a ball and a spring, said spring being located in the interior of said block, said ball being extended from its respective side of said block; and a securing pin being generally U-shaped and having a pair of spaced apart elongate arms being connected by a cross member, said arms of said securing pin being removably inserted through one of said sides of said sole and into said hole and said block, said cross member of said securing pin having an arcuate portion being extended in a direction opposite said arms of said securing pin.

7. A shoe, comprising a sole having a lower surface;

said lower surface of said sole having a hole therein positioned towards a heel end of said sole, said hole having a perimeter comprising a number of sides;

each of said sides of said perimeter of said hole having an aperture therein;

a heel having an upper end;

said upper end of said heel having a block being outwardly extended therefrom, said block having a number of sides, each of said sides of said block being associated with a side of said perimeter of said hole;

said block being inserted into said hole of said lower surface of said sole;

each of said sides of said block having a detent, each of said detents being inserted into the aperture of its associated side of said perimeter of said hole; and each of said detents comprising a ball and a spring, said spring being located in the interior of said block, said ball being extended from its respective side of said block.

8. The shoe of claim 7, wherein said perimeter of said hole is generally rectangular perimeter, and wherein said sides of said block define a generally rectangular block perimeter.

9. The shoe of claim 7, further comprising a securing pin being removably inserted through one of said sides of said sole and into said hole and said block.

10. The shoe of claim 9, wherein said securing pin is generally U-shaped and has a pair of spaced apart elongate arms being connected by a cross member, said arms of said securing pin being removably inserted through said one of said sides of said sole and into said hole and said block.

* * * * *